United States Patent [19]

Ferri

[11] 4,104,819

[45] Aug. 8, 1978

[54] TOY WEAPON

[75] Inventor: Giampiero Ferri, Florence, Italy

[73] Assignee: Edison Giocattoli S.p.A., Florence, Italy

[21] Appl. No.: 809,401

[22] Filed: Jun. 23, 1977

[30] Foreign Application Priority Data

Jul. 13, 1976 [IT] Italy ..... 9519 A/76

[51] Int. Cl.[2] ..... F41C 3/06

[52] U.S. Cl. ..... 42/58

[58] Field of Search ..... 42/58, 54

[56] References Cited

U.S. PATENT DOCUMENTS 3,225,480 12/1965 Ferri et al. ..... 42/58

3,740,885 6/1973 Leaman ..... 42/58

3,777,386 12/1973 Eagles ..... 42/58

*Primary Examiner*—Charles T. Jordan

[57] ABSTRACT

A toy weapon, for example a toy pistol, comprises a magazine cylinder for disc-like ammunition comprising an annular array of charges. The ammunition can be loaded into the cylinder in any angular orientation and co-operates with an anvil formed by an annular array of pointed projections. The spacing of the projections is smaller than that of the charges so that at least one projection is aligned with at least one charge, irrespective of the angular position of the ammunition. The successive charges are exploded by means of a trigger-actuated hammer.

6 Claims, 7 Drawing Figures

Fig.1
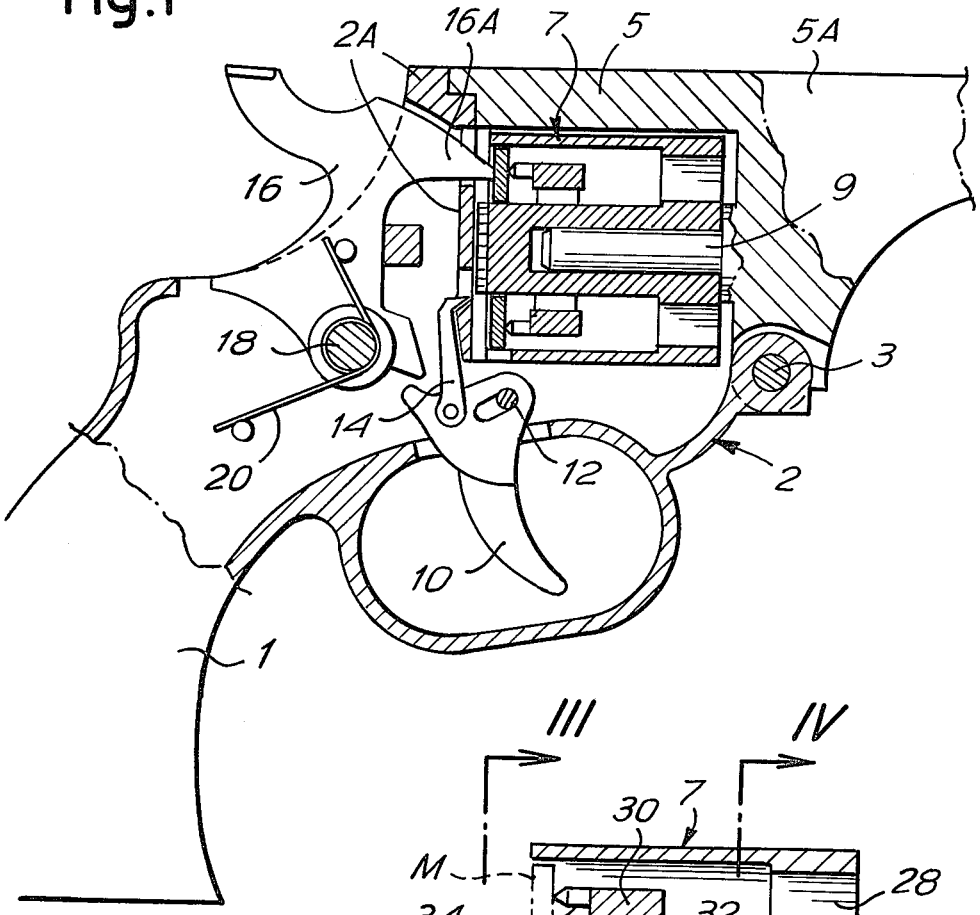
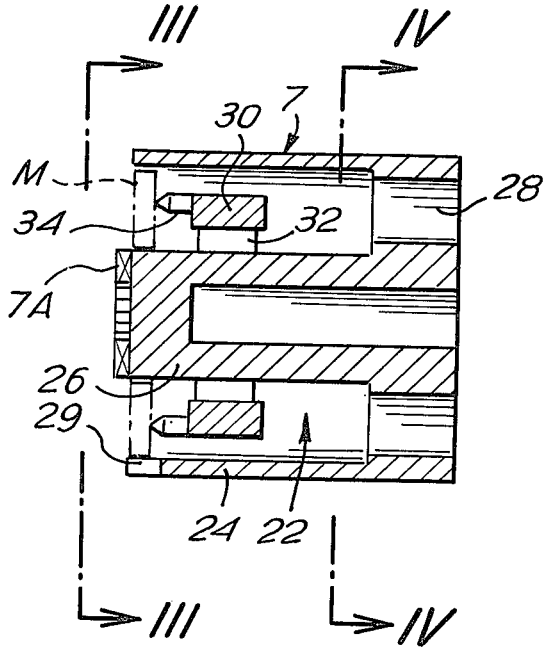
Fig.2

TOY WEAPON

FIELD OF THE INVENTION

The present invention relates to toy weapons.

SUMMARY OF THE INVENTION

According to the invention, there is provided in a toy weapon for use with ammunition of disc-like form containing a plurality of explosive charges, means defining a rotary magazine cylinder for the ammunition, means for advancing the cylinder, a trigger, a hammer operated by the trigger, and means defining an anvil co-operating with the hammer to cause explosion of the charges, the cylinder being such that the ammunition can be positioned in any angular orientation, the anvil comprising an assembly of points spaced one from another by a pitch smaller than that of the charges of the ammunition, and the hammer having a dimension in the direction of spacing of the points of about three-quarters of the pitch of the charges, whereby one charge may be fired after advance of the magazine cylinder by a distance equal to the pitch of the charges.

Further according to the invention, there is provided in a toy weapon for use with ammunition of disc-like form containing a plurality of explosive charges uniformly spaced around the axis of the ammunition, said weapon comprising means defining a rotary magazine for receiving the ammunition with its charges located in any angular orientation about the axis of the magazine, means for advancing the magazine stepwise through steps having a pitch equal to the spacing between the adjacent charges of the ammunition, a hammer engageable with the ammunition to explode the successive charges, a trigger operative to actuate the hammer, and means defining an anvil for supporting the ammunition against the action of the hammer, said anvil comprising a series of projections arranged in an annular array around the axis of the magazine, with adjacent projections being spaced by a distance less than the spacing between the adjacent charges of the ammunition whereby at least one projection is aligned with each charge irrespective of the angular position of the ammunition in the magazine and the width of the hammer being such that the hammer can explode a respective charge after each stepwise advance of the magazine irrespective of the angular position of the ammunition in the magazine.

BRIEF DESCRIPTION OF THE DRAWINGS

An embodiment of the invention will now be described, by way of example only, with reference to the accompanying diagrammatic drawings, in which:

FIG. 1 is a longitudinal section of a toy weapon in accordance with the invention;

FIG. 2 is a longitudinal section, to an enlarged scale, of a magazine cylinder of the weapon;

DESCRIPTION OF THE PREFERRED EMBODIMENT

Figure 3:
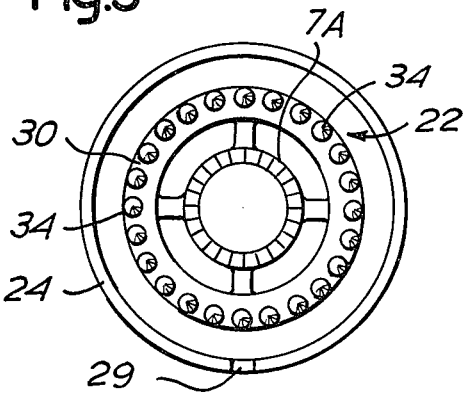
FIG. 3 is a view along line III—III of FIG. 2.
Figure 4:
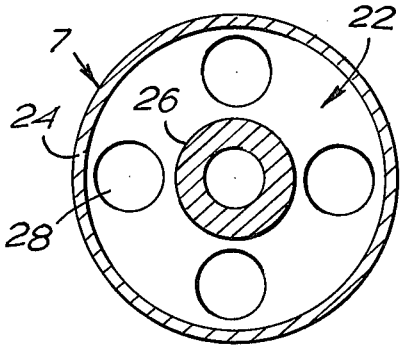
FIG. 4 is a section taken on line IV—IV of FIG. 2.

The toy weapon shown in the drawing is in the form of a pistol comprising a stock 1 which also forms a casing 2 containing a tripping and advance mechanism. A pin 3 connects the main body 5 of the pistol to the casing 2, the body 5 carrying a barrel 5A. The body 5 defines, at least partly, a seat for a magazine cylinder 7 which is rotatable about an axis defined by a pin 9 carried by the body 5. When the weapon is closed, the cylinder 7 is located between the body 5 and the forward portion 2A of the casing 2. The cylinder 7 can be rotated by a trigger 10, which controls tripping and advance in a conventional manner. The tripping and advance mechanism comprises, in addition to the trigger 10, a trigger linking pin 12, and a pawl 14 which acts through a slot in a casing wall 2A, on an annular array of teeth 7A which are provided on the cylinder 7 to permit advance thereof. The trigger 10 also acts on a trip lever 16 pivoted at 18 so as to be movable by the trigger in order to cock and then release a hammer 16A formed by the lever 16. The illustrated mechanism associated with the trigger is of a conventional type.

Figure 5:
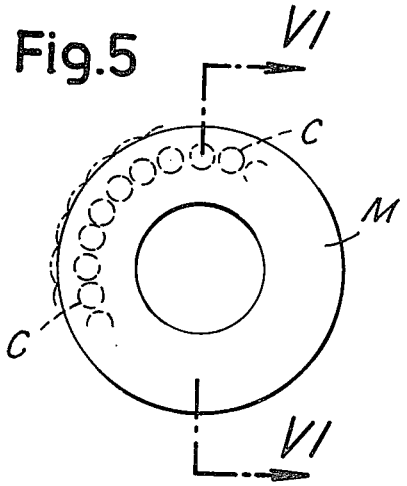
FIG. 5 is a front elevation of ammunition for use with the weapon.
Figure 6:
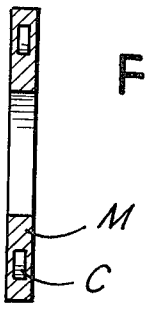
FIG. 6 is a section taken on line VI—VI of FIG. 5.

The cylinder 7 is formed with an annular recess 22 defined between an outer shell-like wall 24 and an inner core 26 carrying the teeth 7A, and in which an axial hole for the pin 9 is provided. The annular recess 22 is open at the front via a plurality of holes 28 which permit the discharge of the gases produced by the exploding charges, the gases passing to the atmosphere through suitable openings in the casing 5. Rearwardly, the recess 22 is entirely open and its mouth constitutes a seat for disc-like ammunition M which is shown in detail in FIGS. 5 and 6. This ammunition M has an outer diameter corresponding to the inner diameter of the shell 24, and has a central opening, the diameter of which corresponds to that of the core 26. Thus, the ammunition can be inserted into the seat formed by the opening of the recess 22 between the shell 24 and the core 26. The ammunition is slightly forced into the seat and tends to deform under effects of the explosions in order to improve the retaining action in the seat. To remove the ammunition after use, one or more recesses 29 are provided in the periphery of the ammunition to receive a pin or other tool for extracting the used ammunition.

Figure 7:
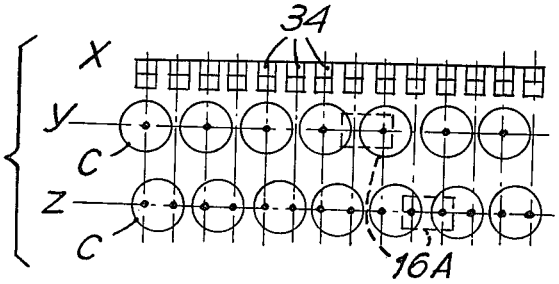
FIG. 7 is a developed view showing possible positions of the explosive charges of the ammunition in relation to projections forming an anvil of the weapon.

An annular structure 30 is provided within the recess 22. The structure 30 is preferably supported from the core 26 via radial webs 32 so that a relatively broad space for the outlet of gases is provided inwardly and outwardly of the structure 30. On the structure 30 there is provided a series of pointed projections 34 which collectively define an anvil which co-operates with the hammer 16A to explode the charges. The projections 34 are arranged in an annular array around the circumference of the structure and are closely spaced with a pitch which is less than that of the charges of the ammunition. The projections 34 are directed rearwardly towards the rear surface of the magazine and are spaced therefrom by a distance which is at least the thickness of the disc-like ammunition M. In this way the axial position of the ammunition M is defined when the ammunition is inserted into the recess 22. The projections 34 can be obtained by radial millings on a shaped continuous edge, as shown in FIGS. 2 and 7, or by circular plugs, as shown in FIG. 3.

The disc-like ammunition M comprises a disc-like casing of thermoplastics material in which is embedded a set of explosive charges or pellets. These charges are denoted by C and are uniformly arranged in an annular array. The spacing between adjacent projections 34 is equal to, or less than, half the spacing between adjacent charges *c* of the projections 34. From FIG. 7 it will be seen that, whatever the angular position of the explosive charges *c* of the ammunition M may be in relation to the angular position of the projections 34 there is always at least one projection directly in front of an explosive charge, when the hammer 16A is released to fire a charge. From the central position shown in the upper row, indicated by *y* in FIG. 7, wherein the projections indicated in the row *x* are centered with respect to the charges *c* indicated in the row *y*, to the offset position shown in the row *z* in FIG. 7, each charge is always associated with at least one of the projections 34. The only irregularity which can occur is at the first explosion when it might happen that two explosive charges are exploded at the same time by the percussive action of the hammer 16A. However, after the first angular advance of the ammunition, only single charges will subsequently be fired irrespective of the angular position of the ammunition M within the recesses.

The width of the hammer is about three-quarters of the pitch between the explosive charges.

The arrangement described allows the ammunition to be loaded into the cylinder 7 without the need to provide for a specific angular orientation between the ammunition and the cylinder 7. In this manner, loading of the weapon can be effected without difficulty by a child.

What is claimed is:

1. In a toy weapon for use with ammunition of disc-like form containing a plurality of explosive charges, means defining a rotary magazine cylinder for the ammunition, means for advancing the cylinder, a trigger, a hammer operated by the trigger, and means defining an anvil co-operating with the hammer to cause explosion of the charges, the cylinder being such that the ammunition can be positioned in any angular orientation, the anvil comprising an assembly of points spaced one from another by a pitch smaller than that of the charges of the ammunition, and the hammer having a dimension in the direction of spacing of the points of about three-quarters of the pitch of the charges, whereby one charge may be fired after advance of the magazine cylinder by a distance equal to the pitch of the charges.

2. A weapon according to claim 1, intended for use with ammunition of annular form, wherein the magazine cylinder comprises inner and outer concentric walls defining therebetween an annular seat for the ammunition, the inner wall of the cylinder engaging the inner periphery of the ammunition, and the outer wall engaging the outer periphery of the ammunition.

3. A weapon according to claim 1, wherein the points are spaced by a distance equal, at most, to half the pitch of the charges.

4. A weapon according to claim 1, wherein the points are formed by radially milling a continuous annular projection.

5. A weapon according to claim 2, wherein the magazine cylinder further comprises an annular body located in said annular recess, and a plurality of spaced webs supporting the body from one of the walls, said body carrying said points.

6. In a toy weapon for use with ammunition of disc-like form containing a plurality of explosive charges uniformly spaced around the axis of the ammunition, said weapon comprising means defining a rotary magazine for receiving the ammunition with its charges located in any angular orientation about the axis of the magazine, means for advancing the magazine stepwise through steps having a pitch equal to the spacing between the adjacent charges of the ammunition, a hammer engagable with the ammunition to explode the successive charges, a trigger operative to actuate the hammer, and means defining an anvil for supporting the ammunition against the action of the hammer, said anvil comprising a series of projections arranged in an annular array around the axis of the magazine, with adjacent projections being spaced by a distance less than the spacing between the adjacent charges of the ammunition whereby at least one projection is aligned with each charge irrespective of the angular position of the ammunition in the magazine and the width of the hammer being such that the hammer can explode a respective charge after each stepwise advance of the magazine irrespective of the angular position of the ammunition in the magazine.

* * * * *